US009022121B1

(12) United States Patent
Penisson

(10) Patent No.: US 9,022,121 B1
(45) Date of Patent: May 5, 2015

(54) BACK-UP RING FOR A LINER TOP TEST TOOL

(75) Inventor: Dennis Joel Penisson, Raceland, LA (US)

(73) Assignee: Wellbore Specialties, LLC, Houma, LA (US)

( * ) Notice: Subject to any disclaimer, the term of this patent is extended or adjusted under 35 U.S.C. 154(b) by 370 days.

(21) Appl. No.: 13/530,278

(22) Filed: Jun. 22, 2012

(51) Int. Cl.
*E21B 34/00* (2006.01)
*E21B 47/022* (2012.01)

(52) U.S. Cl.
CPC ..... *E21B 47/022* (2013.01)

(58) Field of Classification Search
USPC ..... 277/584, 422, 342; 137/512.1, 516.11, 137/516.13, 516.15, 517; 166/332.1, 320, 166/325, 332.4; 175/232, 323, 234, 325, 175/243; 251/324, 333, 361
See application file for complete search history.

(56) References Cited

U.S. PATENT DOCUMENTS

| | | | | |
|---|---|---|---|---|
| 2,812,025 | A | 11/1957 | Teague et al. | |
| 3,605,896 | A | 9/1971 | Perkins | |
| 3,628,799 | A | 12/1971 | Wiese | |
| 4,493,373 | A | 1/1985 | Jackson | |
| 4,531,749 | A | 7/1985 | Jackson et al. | |
| 4,576,386 | A | 3/1986 | Benson et al. | |
| 4,826,182 | A | 5/1989 | Rodriguez | |
| 4,840,379 | A | 6/1989 | Thoman, Jr. | |
| 5,961,123 | A | 10/1999 | Ingram et al. | |
| 6,173,964 | B1 | 1/2001 | Bell et al. | |
| 6,510,868 | B2 * | 1/2003 | Penza | 137/516.23 |
| 6,758,478 | B1 | 7/2004 | Moreno | |
| 7,455,115 | B2 * | 11/2008 | Loretz et al. | 166/373 |
| 7,703,533 | B2 | 4/2010 | Ashy et al. | |
| 7,819,199 | B2 | 10/2010 | Freyer | |
| 2007/0222162 | A1 | 9/2007 | Stoner | |
| 2009/0189358 | A1 | 7/2009 | Briscoe et al. | |

* cited by examiner

*Primary Examiner* — Kenneth L Thompson
*Assistant Examiner* — Steven MacDonald

(57) ABSTRACT

A back-up ring for use in a liner top test tool for testing casing integrity in a wellbore is disclosed. The back-up ring is comprised of first and second ring elements that are biased apart by a compression springs. The first ring element has a plurality of radially extending flanges that cover a plurality of channels in the second ring element when the back-up ring is compressed against a seal element on the liner top test tool to seal the wellbore casing.

14 Claims, 5 Drawing Sheets

BACK-UP RING FOR A LINER TOP TEST TOOL

FIELD OF INVENTION

The present invention relates to field of oil and gas drilling and production. More particularly, the invention relates to an apparatus and method for sealing the annulus between the well casing and liner in a borehole of an oil and gas well.

BACKGROUND

Oil and gas wells typically require boreholes that are drilled into the earth where zones of oil or gas will be encountered. A borehole is usually lined or cased with a heavy-weight steel pipe called casing that is secured in place in the well borehole by cement that is injected between the outer surface of the casing and the borehole. Depending upon the depth of the well, additional segments of smaller diameter casing, called liner pipe, are suspended in sequence from the pipe casing and each other to extend the casing of the well borehole. When liner pipe is so suspended, a gap is created between inner and outer surfaces of the succeeding adjoining liner pipe segments.

Once the liner pipe is suspended and set in place, heavy drilling mud in the well bore is used to contain any leak occurring between casing and liner. A liner seal is then installed between the top and bottom of adjoining segments of different diameter casing or liner pipe to pressure seal any annular joint spaces created between the upper and lower liner pipe segments. When such liner seals are placed in a wellbore casing or liner, it is important to pressure test the integrity of these seals before the heavy drilling mud is removed.

A liner top test tool is used to test the integrity of the liner seal. A typical liner top test tool will have a plurality of resilient annular seal plugs that are positioned on a back-up ring or rings and a mill-head restrained by shear pins that creates fluid passages or flow paths between the seal plug back-up rings and the mill-head.

For use the liner top test tool is positioned on a work-string and slowly lowered into the wellbore through the heavy drilling mud. The drill bit on the work-string serves as a guide until the liner top test tool comes in contact with the top of the lower liner. The mill-head is then rotated to loosen any extraneous cement or debris from the liner top and heavy mud is circulated into the work-string and out of the casing to carry and remove any loosened debris from the casing.

The work-string weight on the mill-head is then increased to shear the mill-head restraining pins. When the mill-head restraining pins are sheared, the mill-head is pushed against the seal back-up rings to squeeze the resilient seals against the top of the lower liner, block the flow paths between the seal plug back-up ring and the mill-head, and form a pressure seal between the liner top test tool and the casing. In most test procedures pressure on the seal will be from the top down.

When the liner top test tool is positioned at the top of the lower liner, the fluid force in the work-string and the casing are still in balance. The work-string and test tool are then raised a few feet above the liner top and a light fluid such as seawater is pumped into the work-string until the heavy mud is pushed to a few feet above the test tool. The pressure of the light fluid now balances the force of the heavy mud. The light fluid is then slowly bled down from work-string to a point where it is determined that the light fluid can contain well pressure and that there is no leak at the pressure seal between the liner top test tool and the casing. When such condition exists, the heavy mud is no longer needed to contain the well pressure. The liner top test tool may then be pulled up, the seals released, and the heavy mud may then be pumped out of the well.

A problem with previous liner top test tool seal back-up ring designs is the restricted fluid flow passages that are created between the test tool, with the seals and back-up rings, and the casing wall as the test tool, with the seals and back-up rings, is moved through heavy mud into or out of the casing. A restriction on the diameter of a tool is its "drift diameter". Drift diameter is a casing term determined by formula which gives the largest diameter tool that can be passed or run through a casing of a certain size/weight. It is common for tools to have drift diameters only 0.125 inches less than the interior diameter ("ID") of the of casing. In such a situation, only 0.062 inch gap would exist between the casing ID and back-up ring OD. This leaves a limited fluid flow passage.

The limited fluid flow passages or paths also limit the cross-sectional area provided to deliver high pressure on the seal as well as impede the mud flow needed to carry the debris out of the well. In performing such a seal test, it would be an advantage have a liner top test tool with back-up seal rings that would provide an increase in the fluid passage area between the back-up rings and the mill-head in order to produce a resulting increase in mud fluid flow rates and an increase in the seal test pressure rating.

Traditional seal back-up rings are one piece solid rings. These rings, when sized to maximum drift diameter, limit fluid flow over the back-up ring when the seal is not set. If the back-up ring is much smaller than the drift diameter the fluid flow over the ring increases but the chance of seal extrusion over the ring increases. At higher test pressures a seal can extrude over the edges of a back-up ring like oozing bubble gum.

SUMMARY OF THE INVENTION

The present invention provides a back-up ring for the seals of a liner top test tool that will satisfy the aforementioned needs. The seal back-up ring is comprised of first or upper ring and an interconnected longer second or lower ring and a means to move the first ring away from the second ring along the axis of the casing. The first ring has a plurality of radially extend ring flanges that intersect with a like number of fluid channels on the radial surface of the second ring. Moving the first ring away from the second ring along the axis of the casing serves to create an enhanced flow passage between the back-up ring and the casing along the fluid channels on the radial surface of the second ring. Once the liner top test tool with the associated back-up ring and seals is placed comes in contact with the top of the lower liner the first ring is moved toward the second ring to close the fluid channels on the radial surface of the second ring. The seals can then be squeezed against casing in the conventional manner to form a pressure seal between the liner top test tool and the casing.

The two part seal back-up ring described herein can be sized to maximum drift diameter and separated for high flow rates. Because the flow passages of the back-up can be enhanced for ease of insertion of the liner top test tool by separation of the rings and then closed to effectuate the sealing during testing, use of the back-up ring described herein will allow for higher fluid flow rates and higher test pressures.

Figure 1:
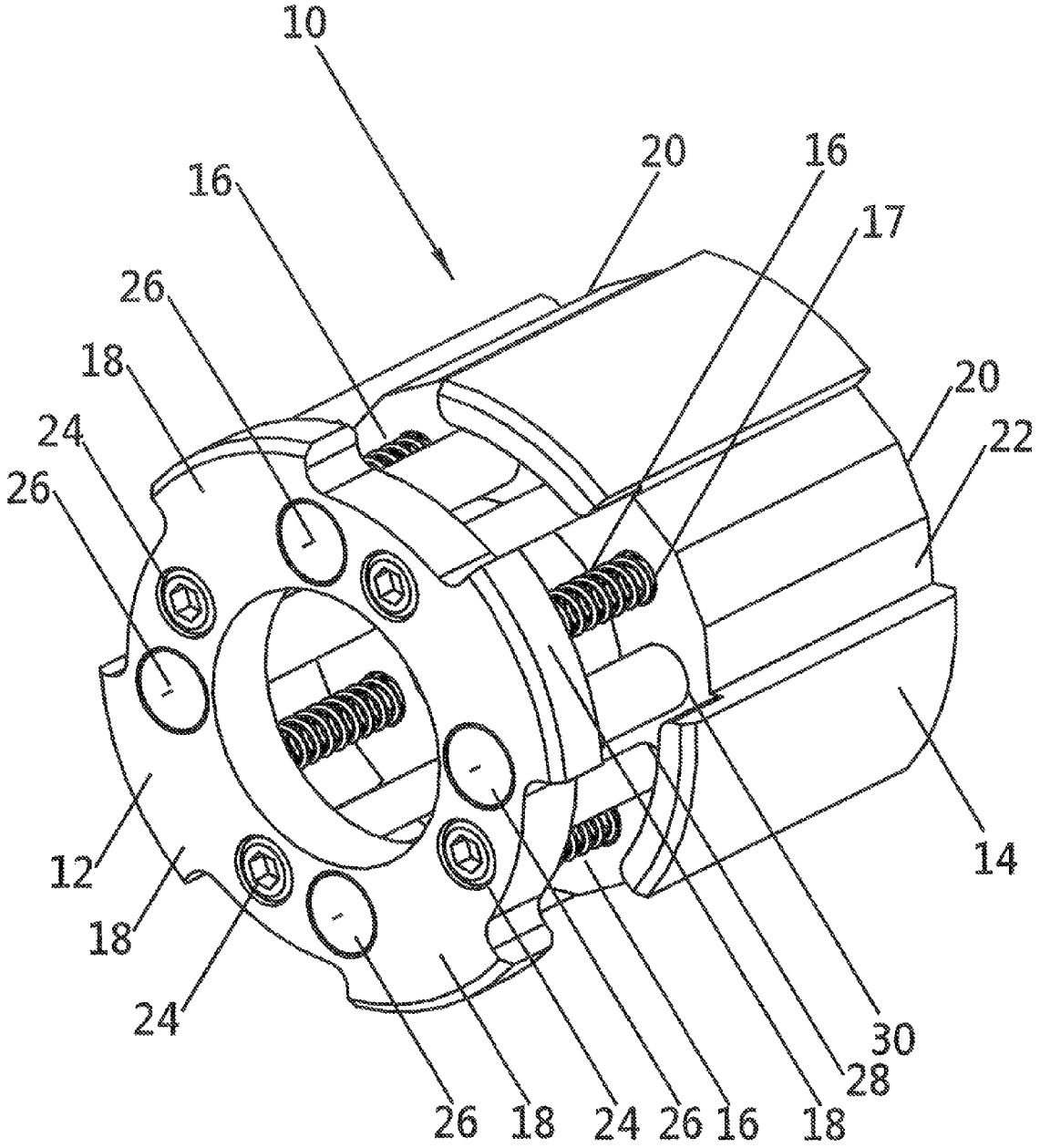
FIG. 1 is an isometric view of the back-up ring for the seals of a liner top test tool shown in open position.

In the drawings, certain features that are well established in the art and do not bear upon points of novelty may have been omitted in the interest of descriptive clarity. Such omitted features may include threaded junctures, weld lines, sealing elements, pins and brazed junctures.

DESCRIPTION OF EMBODIMENT

Referring now to the drawings and more particularly to FIG. 1, there is shown an isometric view of the back-up ring (10) for the seals of a liner top test tool of applicant's invention. The seal back-up ring (10) is comprised of first ring (12) and an interconnected longer or thicker second ring (14). The first ring (12) is biased away from the second ring (14) along the central axis of the rings (12) and (14) by a plurality of compression springs (16) fitted to and distributed about the periphery of the first and second rings in spring races (17).

The first ring (12) has a plurality of radially extend ring flanges (18) that intersect with a like number of fluid flow passages or channels (20) that are distributed radially on the peripheral surface (22) of the second ring (14). When the compression springs (16) are extended, the springs (16) move the first ring (12) away from the second ring (14) along the central axis of the rings (12) and (14) to open the flow channels (20). When the springs (16) are compressed, the first ring (12) moves toward the second ring (14) along the central axis of the rings (12) and (14) to close the flow channels (20).

The first ring (12) and an interconnected longer second ring (14) of the seal back-up ring (10) are held together longitudinally by means of a plurality of assembly bolts (24) and alignment pins (26). The assembly bolts (24) and alignment pins (26) are distributed around and connected to the first ring (12). The assembly bolts (24) and alignment pins (26) slide into bolt and pin alignment guides (28) and (30), respectively. The bolt alignment guides (28) and pin alignment guides (30) are bored into the second ring (14) along its longitudinal axis. When the springs (16) are compressed, the flanges (18) of the first ring (12) will move toward each other and the assembly bolts (24) and alignment pins (26) will slide into the bolt alignment guides (28) and pin alignment guides (30), respectively, as the back-up ring (10) is closed. The bolt (24) also serves as a travel limiter when seal-rings (12) and (14) are spread apart.

FIG. 1 shows the seal back-up ring (10) in an open position with the first ring (12) extended away from the thicker second ring (14) by means of the extended springs (16). When the back-up ring (10) is in the open position, the flow channels (20) create an enhanced fluid flow path around the peripheral surface (22) of the second ring (14).

Figure 2:
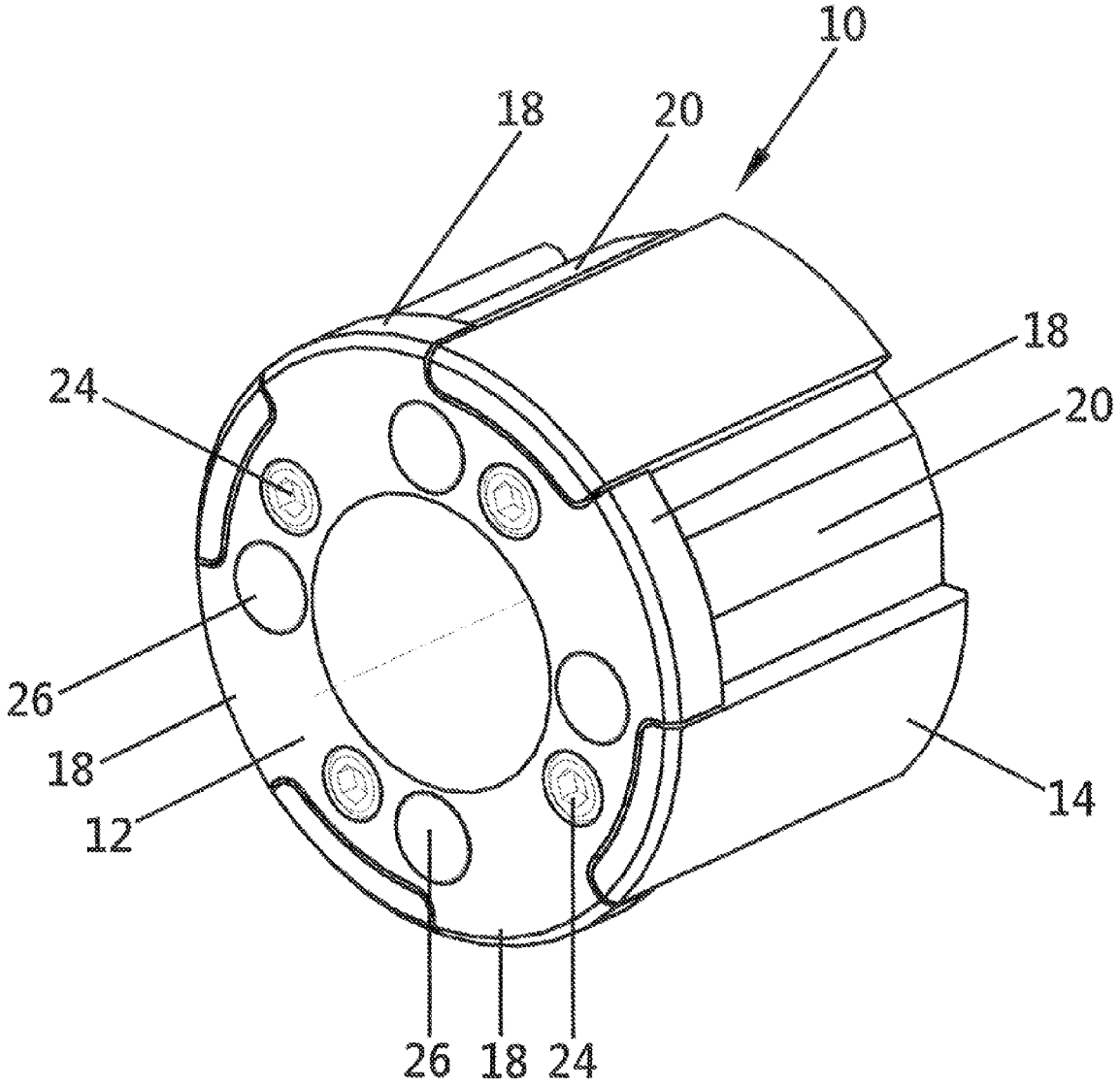
FIG. 2 is the seal back-up ring of FIG. 1 shown in the closed position.
Figure 3:
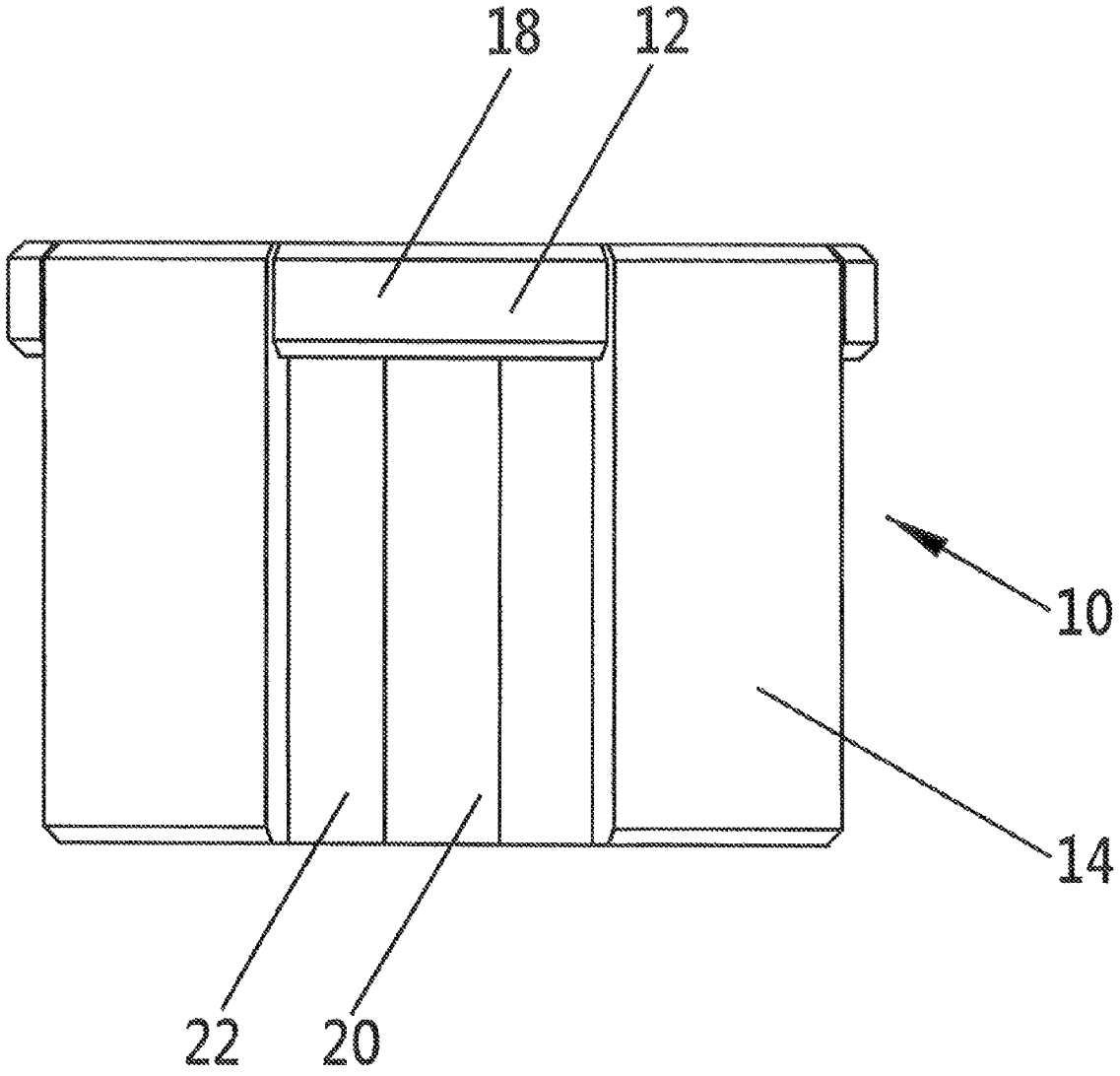
FIG. 3 is a side view of the seal back-up ring shown in FIG. 2.

FIG. 2 is the seal back-up ring (10) of FIG. 1 shown in the closed position. When the back-up ring is in a closed position, the springs (16) are compressed and the first ring (12) is fitted against the second ring (14). When so fitted, the flanges (18) of the first ring (12) cover the flow channels (20) of the second ring so that the flow channels (20) are closed or blocked to restrict fluid flow around the peripheral surface (22) of the second ring (14).

OPERATION

Figure 4:
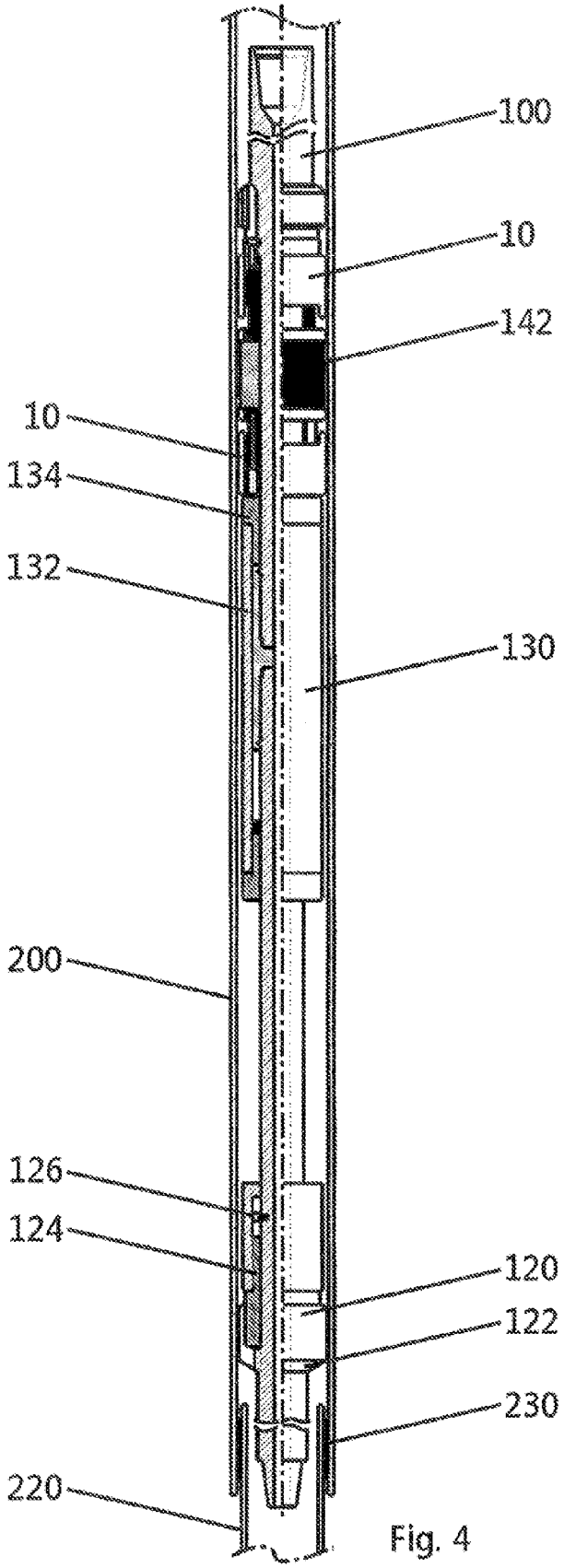
FIG. 4 is partial cross-section view of a liner top test tool incorporating the seal back-up ring of FIG. 1 positioned in a wellbore.
Figure 5:
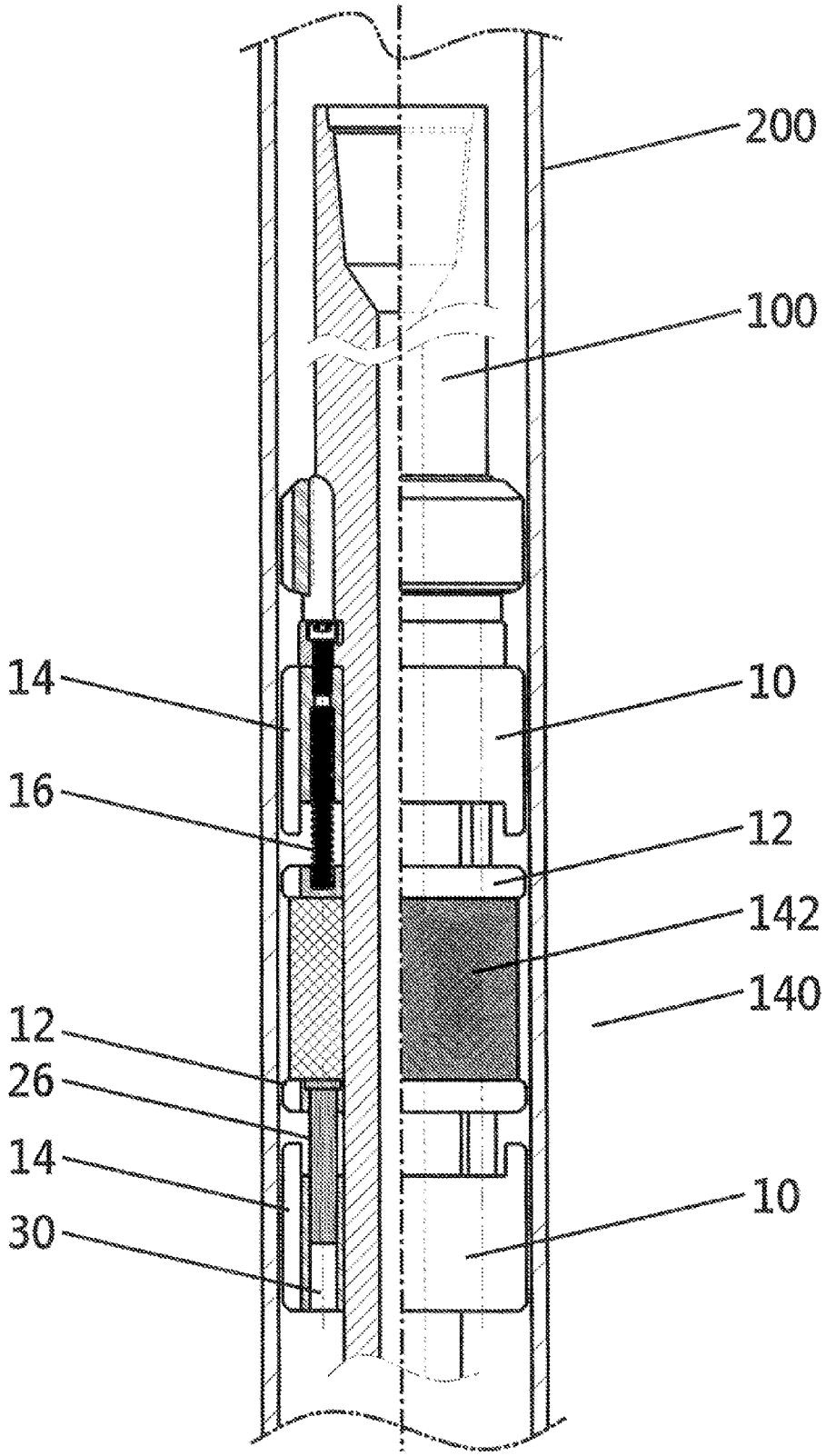
FIG. 5 is detail cross-section view of the back-up ring shown in FIG. 1 shown incorporated into the liner top test tool shown in FIG. 4.

Referring now to FIG. 4 and FIG. 5, there is shown the seal back-up ring (10) incorporated into a liner top test tool (100). The liner top test tool (100) has a mill-head assembly (120), a coupling assembly (130) and a seal assembly (140). The mill-head assembly (120) is comprised of a mill-head (122), a shear disk (124), and a plurality of shear pins (126). The seal assembly (140) is comprised of the compressible seal element (142) positioned between upper and lower seal back-up rings (10) as described herein.

The coupling assembly (130) is attached to the upper end mill-head assembly (120) and the lower end of the seal assembly (140). The coupling assembly has a sleeve (132) and a cap (134) which will bear against the lower seal back-up ring (10) seal of the seal assembly (140) to compress seal element (142) between the upper and lower back-up rings (10). It is thought that the seal element (142) will have a smaller outside diameter than the outside diameter of the backup rings. The smaller diameter of the seal element will allows more space for fluid flow.

In use, to test the seal (230) between a casing (200) and a lower liner (220), the liner top test tool (100) is incorporated onto a work-string and slowly lowered into the casing (200) of a wellbore through heavy drilling mud. A drill bit on the work-string may serve as a guide until the liner top test tool (100) comes in contact with the top of the lower liner (220) in the wellbore.

When the liner top test (100) is being lowered into the wellbore, the back-up ring (10) is in the open position. In this position, the compression springs (16) of the back-up ring (10) are extended to move the first ring (12) away from the second ring (14) to open the flow channels (20) around the periphery of the back-up ring. When the flow channels (20) are open, the flow area between the wellbore casing (200) around the back-up ring (10) will be enhanced.

Once the liner top test tool (100) is placed in a desired position with respect to the top of the lower liner (220), the drill string is rotated to rotate the mill-head (122) to loosen any extraneous cement or debris around the top of the liner (220) as heavy mud is circulated into the work-string. The flow of heavy mud and associated loosened debris will move up and out of the casing (200) through the flow channels (20) around the back-up rings (10).

The work-string weight on the mill-head (122) is then increased to move the shear disk (124) against the shear pins (126) in order to cut or shear the shear pins (126). When shear pins (126) are sheared, the mill-head assembly (120) will slide against the coupling assembly (130) and the sleeve (132) will push the cap (134) to engage the lower back-up ring (10) to compress the seal element (142) of the seal assembly (140) against the back-up ring (10). As the seal element is compressed between the back-up rings (10), the springs (16) of the back-up rings (10) will compress and move the first ring (12) against the second ring (14) of each back-up ring so that the flanges (18) will block the flow channels (20) around the periphery of the back-up rings (10). This will form a pressure seal between the liner top test tool (100), liner top (220), and the casing (200).

When the liner top test tool (100) is positioned at the top of the lower liner (220), the fluid force in the work-string and the casing (200) are still in balance. The work-string and test tool (100) may then be raised a few feet above the top of the lower liner (220) and a light fluid such as seawater is then pumped into the work-string until the heavy mud is pushed up the casing (200) to a few feet above the test tool (100). The pressure of the light fluid now balances the force of the heavy mud. The light fluid is then slowly bled down from work-string to a point where it is determined that the light fluid can contain well pressure and that there is no leak at the pressure seal between the liner top test tool and the casing. When such condition exists, the heavy mud is no longer needed to contain the well pressure. The liner top test tool (100) may then be pulled up to release the seal element (142), and the heavy mud may then be pumped out of the wellbore.

What is claimed is:

1. A back-up ring for use in a liner top test tool for testing the seal provided between adjacent wellbore casing placed in a wellbore said liner top test tool having compressible seal element, the back-up ring comprising:

a) a first ring, said first ring having a plurality of radially extending flanges;

b) a second ring, said second ring having a plurality of channels on the peripheral surface of said second ring, each channel of said second ring corresponding with one of said radially extending flanges of said first ring;

c) means for biasing said first ring away from said second ring along the longitudinal axis of said wellbore;

d) at least one alignment pin attached to said first ring; and e) an alignment guide in said second ring for receiving said alignment pin.

2. The back-up ring as recited in claim 1, wherein said means for biasing said first ring away from said second ring is at least one compression spring.

3. The back-up ring as recited in claim 1, further comprising:

(a) a plurality of attachment bolts fixed to said first ring; and (b) means for slidably receiving said attachment bolts within said second ring.

4. The back-up ring as recited in claim 1 wherein said radially extending flanges of said first ring are moved against said channels of said second ring thereby blocking said plurality of channels in said second ring and reducing the area of a flow path between said back-up ring and said casing when said liner top tool is placed in said well bore.

5. The back-up ring as recited in claim 4 wherein said radially extending flanges of said first ring are biased away from said channels of said second ring thereby enhancing the area around the periphery of said second ring and said casing when said liner top tool is placed in said wellbore.

6. A back-up ring for use in a liner top test tool for testing the seal provided between adjacent casing of different diameters placed in a wellbore, said liner top test tool having compressible seal element and a means for engaging said back-up ring with said compressible seal element and thereby compressing said seal element, the back-up ring comprising:

a) a first ring, said first ring having a plurality of radially extending flanges;

b) a second ring, said second ring having a plurality of channels on the peripheral surface of said second ring, each channel of said second ring corresponding with one of said radially extending flanges of said first ring;

c) a plurality of compression springs for biasing said first ring away from said second ring along the longitudinal axis of said first and second rings thereby creating an enhanced flow area around the periphery of said second ring when said liner top tool is placed in wellbore;

d) a plurality of alignment pins attached to said first ring; and e) an alignment guide in said second ring for slidably receiving each said alignment pin.

7. The back-up ring as recited in claim 6 wherein when said back-up ring is engaged to compress said compressible seal element of said liner top test tool, the space between said first ring and said second ring will be reduced to close said channels on said second ring and restrict the flow area around the periphery of said second ring.

8. The back-up ring as recited in claim 7, further comprising:

(a) at least one attachment bolt fixed to said first ring; and (b) means for slidably receiving said attachment bolt within said second ring.

9. In a liner top test tool for testing the integrity of casing in a wellbore, said liner top test tool being attached to a drill string and positioned in a cased wellbore containing drilling fluid and having means for engaging a back-up ring with a compressible seal element for sealing said wellbore casing, said back-up ring comprising:

a) a first ring, said first ring having a plurality of radially extending flanges;

b) a second ring, said second ring having a plurality of fluid flow channels on the radially spaced around the periphery of said second ring, each fluid flow channel corresponding to one of said radially extending flanges of said first ring;

(c) at least one attachment bolt fixed to said first ring;

(d) a means for slidably receiving said attachment bolt within said second ring; and (e) means for biasing said first ring away from said second ring along the longitudinal axis of said well bore.

10. The back-up ring as recited in claim 9, further comprising:

a) at least one alignment pin attached to said first ring; and b) an alignment guide in said second ring for receiving said alignment pin.

11. The back-up ring as recited in claim 10, wherein said means for biasing said first ring away from said second ring is at least one compression spring.

12. The back-up ring as recited in claim 9 wherein when said back-up ring is positioned in said liner top test tool, said flanges of said first ring are positioned away from said channels of said second ring to enhance the fluid flow area around the periphery of said second ring and said cased wellbore.

13. The back-up ring as recited in claim 11 wherein when said back-up ring is positioned in said liner top test tool, movement of said back-up ring against said compressible seal element will reduce the space between said first ring and said second ring to move said flanges of said first ring over said channels of said second ring to restrict the fluid flow area around the periphery of said second ring and said cased wellbore.

14. The back-up ring as recited in claim 10, wherein said attachment bolt limits the travel space between said first ring and said second ring.

* * * * *